US010343005B2

(12) United States Patent
Splane, Jr.

(10) Patent No.: US 10,343,005 B2
(45) Date of Patent: Jul. 9, 2019

(54) EXERCISE MACHINE

(71) Applicant: Robson Lindsay Splane, Jr., Valley Center, CA (US)

(72) Inventor: Robson Lindsay Splane, Jr., Valley Center, CA (US)

( * ) Notice: Subject to any disclaimer, the term of this patent is extended or adjusted under 35 U.S.C. 154(b) by 0 days.

(21) Appl. No.: 15/165,824

(22) Filed: May 26, 2016

(65) Prior Publication Data

US 2016/0346581 A1 Dec. 1, 2016

Related U.S. Application Data

(60) Provisional application No. 62/179,938, filed on May 26, 2015.

(51) Int. Cl.
*A63B 7/00* (2006.01)
*A63B 21/00* (2006.01)
(Continued)

(52) U.S. Cl.
CPC ..... *A63B 7/00* (2013.01); *A63B 21/00069* (2013.01); *A63B 21/012* (2013.01); *A63B 21/015* (2013.01); *A63B 21/068* (2013.01); *A63B 21/4033* (2015.10); *A63B 21/4035* (2015.10); *A63B 21/4047* (2015.10); *A63B 23/0216* (2013.01); *A63B 23/03525* (2013.01); *A63B 23/0482* (2013.01); *A63B 23/0222* (2013.01); *A63B 23/1209* (2013.01);
(Continued)

(58) Field of Classification Search
CPC ... A63B 7/00; A63B 21/4033; A63B 21/4035; A63B 21/4047; A63B 21/00069; A63B 21/012; A63B 21/015; A63B 21/068; A63B 23/0216; A63B 23/03525; A63B 23/0482; A63B 23/0222; A63B 23/1209; A63B 2069/0062; A63B 2208/0204; A63B 2208/0219; A63B 2210/50
USPC ..... 482/114
See application file for complete search history.

(56) References Cited

U.S. PATENT DOCUMENTS 2,300,586 A * 11/1942 Meehan ..... A47C 3/0255 297/184.15
2,567,612 A * 9/1951 Mcgehee ..... A47C 3/0255 248/370
(Continued)

OTHER PUBLICATIONS

Mainstay 3 Seat Porch & Patio Swing. Earliest sale date based on review May 2, 2014. https://www.amazon.com/Mainstay-Seat-Porch-Patio-Swing/dp/B00JH9CZVM/ref=cm_cr_arp_d_product_top?ie=UTF8 (Year: 2014).*
(Continued)

*Primary Examiner* — Andrew S Lo
(74) *Attorney, Agent, or Firm* — Risso I.P.

(57) ABSTRACT

An exercise machine is described. The exercise machine includes a frame formed by a pair of front legs pivotally connected with a pair of rear legs. The frame is movable between an expanded position (for use) where the pair of front legs are pivoted away from the pair of rear legs and a collapsed position (for storage) where the pair of front legs are pivoted toward the pair of rear legs. One or more swinging arms hang from and are pivotally connected with the frame. A swinging platform is connected with the swinging arms. Thus, a user can position a body part upon the swinging platform and perform an exercise by swinging the swinging platform.

3 Claims, 12 Drawing Sheets

(51) Int. Cl.

| | |
|---|---|
| ***A63B 23/02*** | (2006.01) |
| ***A63B 21/012*** | (2006.01) |
| ***A63B 21/015*** | (2006.01) |
| ***A63B 21/068*** | (2006.01) |
| ***A63B 23/035*** | (2006.01) |
| ***A63B 23/04*** | (2006.01) |
| *A63B 23/12* | (2006.01) |
| *A63B 69/00* | (2006.01) |

(52) U.S. Cl.
CPC ..... *A63B 2069/0062* (2013.01); *A63B 2208/0204* (2013.01); *A63B 2208/0219* (2013.01); *A63B 2210/50* (2013.01)

(56) References Cited

U.S. PATENT DOCUMENTS 4,387,893 A * 6/1983 Baldwin ..... A63B 21/06 482/100
4,408,759 A * 10/1983 Reneau ..... A63B 21/012 482/114
4,494,532 A * 1/1985 Masuda ..... A61H 1/0229 482/144
5,000,443 A * 3/1991 Dalebout ..... A63B 21/154 482/114
5,551,937 A * 9/1996 Kwo ..... A61H 1/0229 482/144
5,711,749 A * 1/1998 Miller ..... A63B 23/0222 482/111
5,735,778 A * 4/1998 Piaget ..... A63B 22/0012 482/114
5,741,204 A * 4/1998 Lee ..... A63B 22/001 482/114
5,803,818 A * 9/1998 Tseng ..... A47C 3/0255 384/273
5,971,902 A * 10/1999 Robertson ..... A61H 1/0218 482/142
6,036,622 A * 3/2000 Gordon ..... A63B 21/154 482/51
6,379,289 B1 * 4/2002 Gossie ..... A63B 21/055 482/138
6,383,085 B1 * 5/2002 Tseng ..... A47C 3/0255 297/184.15
7,160,233 B2 * 1/2007 Perez ..... A63B 21/068 482/140
7,247,128 B2 * 7/2007 Oga ..... A63B 23/0405 297/DIG. 10
7,361,128 B2 * 4/2008 Chen ..... A61H 1/0218 482/142
D598,965 S * 8/2009 Augustine ..... D21/673
7,625,323 B1 * 12/2009 Lin ..... A63B 21/015 482/112
D617,855 S * 6/2010 Leier ..... D21/686
7,780,585 B1 * 8/2010 Rivas ..... A63B 21/0552 482/140
7,935,038 B2 * 5/2011 Tyree ..... A63B 23/0494 482/137
8,734,304 B2 * 5/2014 Webber ..... A63B 23/0233 482/140
2003/0162639 A1 * 8/2003 Hsien ..... A63B 21/068 482/144
2005/0272576 A1 12/2005 Simmons
2006/0100070 A1 * 5/2006 Abdo ..... A63B 21/4047 482/121
2007/0111861 A1 * 5/2007 Nativ ..... A63B 21/0552 482/51
2007/0149370 A1 * 6/2007 Brown ..... A63B 21/068 482/140
2007/0184949 A1 * 8/2007 Weir ..... A63B 21/055 482/130
2008/0096744 A1 * 4/2008 Perry, Jr. ..... A61H 1/0218 482/144
2008/0200317 A1 8/2008 Campanaro
2009/0018000 A1 * 1/2009 Brown ..... A63B 21/068 482/140
2009/0312161 A1 * 12/2009 Nohejl ..... A63B 21/0615 482/94
2010/0022367 A1 * 1/2010 McBride ..... A63B 23/0216 482/140
2011/0039662 A1 2/2011 Gordon
2011/0301002 A1 * 12/2011 Sebastian ..... A63B 21/068 482/140
2011/0319232 A1 12/2011 Thorpe
2012/0100973 A1 * 4/2012 Boland ..... A63B 22/14 482/142
2012/0115694 A1 * 5/2012 Chen ..... A63B 22/205 482/142
2013/0331238 A1 * 12/2013 Ellis ..... A63B 21/159 482/97
2015/0297948 A1 * 10/2015 Meister ..... A63B 23/03566 482/122
2016/0038367 A1 * 2/2016 Joung ..... A47C 1/03211 482/144
2016/0038370 A1 * 2/2016 Dreske ..... A61H 3/008 482/68

OTHER PUBLICATIONS

International Search Report and Written Opinion of the International Search Authority for PCT/US2016/034389.

* cited by examiner

EXERCISE MACHINE

CROSS-REFERENCE TO RELATED APPLICATIONS

The present application is a Non-Provisional Utility Patent Application of U.S. Provisional Application No. 62/179,938 filed on May 26, 2015, entitled, "Abs'n Glutes—exercise device for supporting the body & providing variable resistance for abdominal & glute exercises."

BACKGROUND OF THE INVENTION (1) Field of Invention

The present invention relates to an exercise machine and, more particularly, to a manually operated exercise machine for performing a variety of exercises.

(2) Description of Related Art

Exercise machines have long been known in the art and have been conceived in a variety of forms. By way of example, several variable weight exercise machines have been conceived that allow a user to alter the weight that is lifted while performing an exercise. While operable for providing variable resistance, such weight bearing machines are cumbersome and can be extraordinarily heavy. In an attempt to provide variable resistance while limiting the necessity for heavy weights, several exercise machines have been designed that use bands or bows to allow for selective variable resistance. The band and bow devices are often limited to arm and leg exercises and are also typically large machines.

Thus, a continuing need exists for a portable, manually operated exercise device that allows a user to selectively variable the resistance while performing a variety of exercises.

SUMMARY OF INVENTION

Described is a manually operated exercise machine for performing a variety of exercises. An exercise machine is described. The exercise machine includes a frame formed by a pair of front legs pivotally connected with a pair of rear legs. The frame is movable between an expanded position (for use) where the pair of front legs are pivoted away from the pair of rear legs and a collapsed position (for storage) where the pair of front legs are pivoted toward the pair of rear legs. One or more swinging arms hang from and are pivotally connected with the frame. A swinging platform is connected with the swinging arms, whereby a user can position a body part upon the swinging platform and perform an exercise by swinging the swinging platform.

In another aspect, each swinging arm has a length, with the swinging arm being formed of at least two parts such that the length of the swinging arm is selectively adjustable.

In yet another aspect, the one or more swinging arms are pivotally connected with the frame with a thread and an adjustment knob, such that adjustment of the adjustment knob allows for selectively altering friction resistance of the one or more swinging arms.

In another aspect, a forearm support is attached with each front leg such that the forearm support is angled downward and away from the rear legs.

Further, each forearm support includes a rear end and is attached with the front leg such that the rear end is laterally adjustable.

In yet another aspect, a front knee support is connected with and projects up from the swinging platform. A pair of handles are also optionally connected with the front knee support.

Finally, as can be appreciated by one in the art, the present invention also comprises a method for forming and using the exercise machine as described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1A:
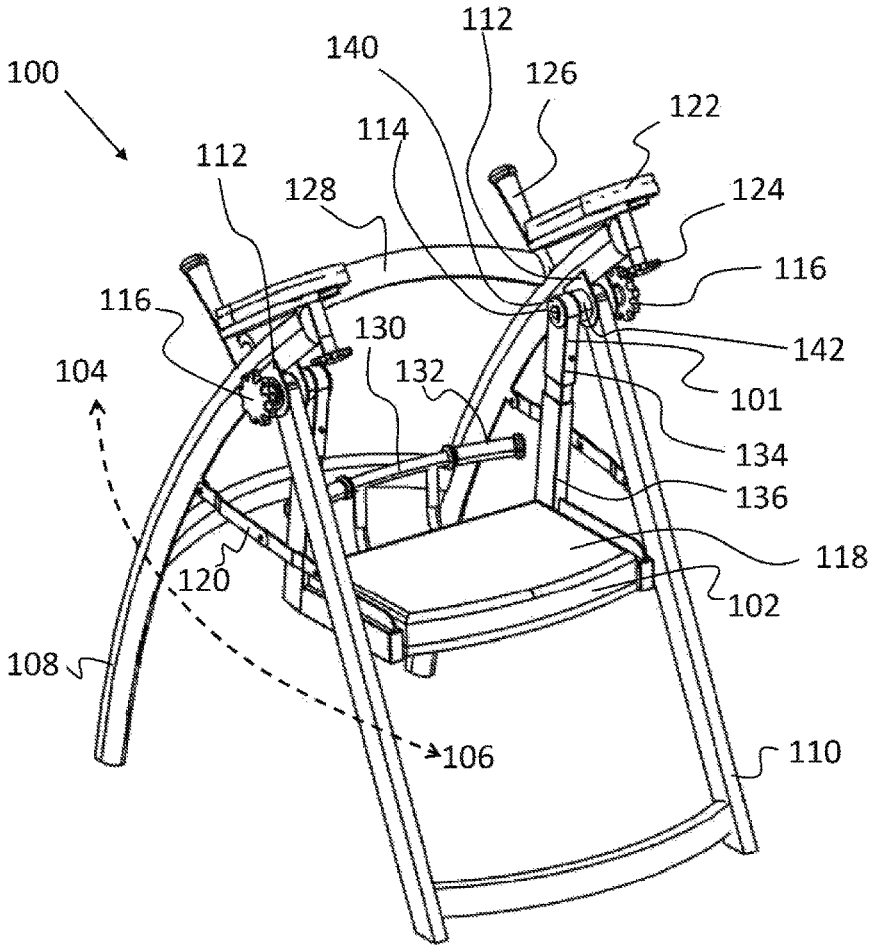
FIG. 1A is an elevated, rear-view illustration of an exercise machine according to various embodiments of the present invention.

The present invention relates to an exercise machine and, more particularly, to a manually operated exercise machine for performing a variety of exercises. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

This disclosure provides a manually operated exercise machine for performing a variety of exercises. As shown in the elevated rear-view illustration of FIG. 1A, the exercise machine 100 includes a frame structure to elevate a swinging platform 102 that hangs from the frame structure via one or more swinging arms 101 (e.g., such as between a pair of swinging arms 101, as depicted). The frame structure is any suitable mechanism or device that is operable for elevating the swinging platform 102 to support a user and provide for ground clearance while the swinging platform 102 swings forward 104 and rearward 106. As a non-limiting example, the frame structure includes a pair of front legs 108 (e.g., steel tubing, etc.) that are pivotally connected with a pair of rear legs 110 (e.g., steel tubing, etc.).

Although not required, the front legs 108 can be bent into arc shape, as shown, to more closely conform to and accommodate a user's body shape than a straight member would. Further and as clearly shown in FIG. 2, a front rail 202 (e.g., metal tubing, etc.) is included for connecting (via welding, screws, etc.) the front legs 108 and a rear rail 204 is included for connecting (via welding, screws, etc.) the rear legs 110. The front and rear rails 202 and 204 are arc shaped rails (or frames) that are curved for multiple reasons. Aside from aesthetics, the curved shape provides additional clearance so that the feet and legs of the user are less likely to strike against these frames.

Referring again to FIG. 1A, the front legs 108 are pivotally connected with the rear legs 110 using any suitable connection mechanism to allow for pivotal rotation between the two components. For example, a pair of pivot brackets 112 are attached with the front 108 or rear legs 110. In the example as shown, the pivot brackets 112 are attached with and extend from the front legs 108. A threaded bolt 114 or other suitable device can then be passed through the swinging arm 101, through the pivot brackets 112 and holes in the rear legs 110 and affixed with a tension control knob 116 that threads onto the threaded bolt 114.

Figure 1B:
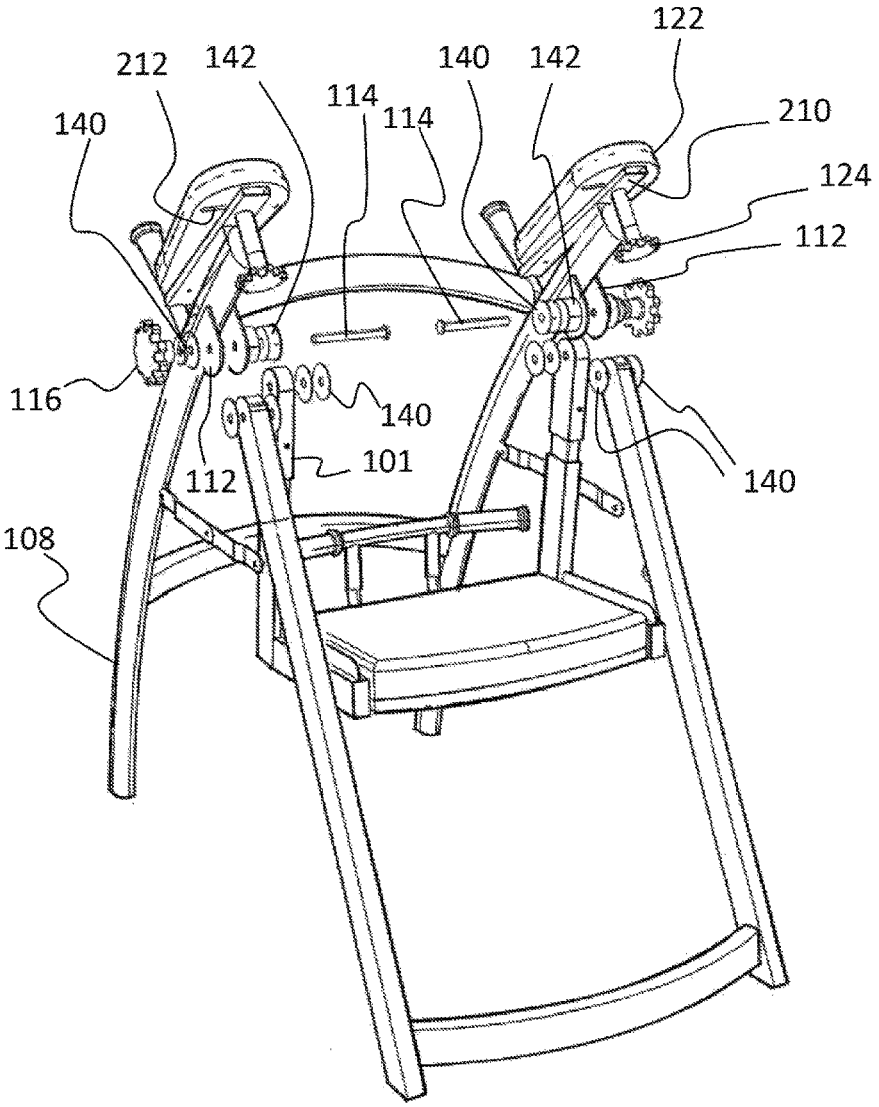
FIG. 1B is an exploded, rear-view illustration of the exercise machine according to various embodiments of the present invention.

The pivotal connection is further illustrated in the exploded view of FIG. 1B. As clearly shown in this non-limiting example, pairs of pivot brackets 112 are attached (e.g., welded, screwed, etc.) to the from legs 108. The rear legs 110 are attached by being positioned between the pairs of pivot brackets 112. The rear legs are each then straddled by, for example, washers 140 (e.g., Teflon® washers). The swinging arms 101 in this non-limiting example are also attached to the pivot brackets 112 using a series of washers 140 and, desirably, friction bushings 142 (e.g., glass filled Noryl® plastic, or any other suitable friction reducing item). All of the aforementioned components can then be affixed as depicted using the threaded bolt 114 and correspondingly threaded tension control knob 116.

Figure 6A:
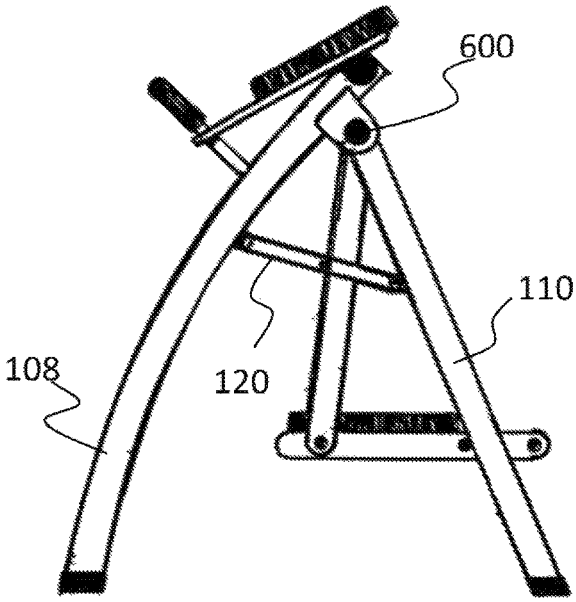
FIG. 6A is a side-view illustration of the exercise machine according to various embodiments of the present invention, depicting the exercise machine in an expanded position ready for use.
Figure 6B:
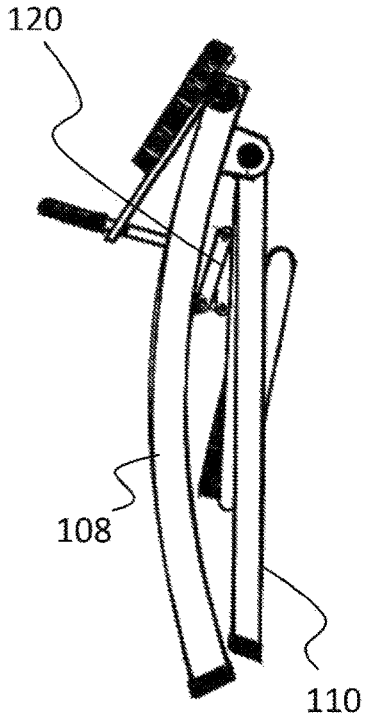
FIG. 6B is a side-view illustration of the exercise machine according to various embodiments of the present invention, depicting the exercise machine in a collapsed position for storage.

Referring again to FIG. 1A, by being pivotally attached with one another, the front legs 108 and rear legs 110 can be collapsed together (as shown in FIG. 6B) to allow for storage of the exercise machine 100. Folding brackets 120 or any other suitable locking mechanism can be connected between the front 108 and rear 110 legs to allow a user to selectively lock the legs 108 and 110 in the expanded position for use (as shown in FIGS. 1A and 6A).

As noted above, the swinging platform 102 hangs from the frame structure via one or more swinging arms 101. Each swinging arm 101 can be connected with the frame structure to allow for swinging motion of the swinging platform 102 using any suitable mechanism or device. In the non-limiting example as provided above, the bolt 114, when threaded through the washers 140, swinging arm 101, friction bushings 142, through pivot brackets 112 and rear legs 110, and into the tension control knob 16, provides for a swinging connection of the swinging arm 101.

It should be noted that the threaded bolt 114 can be keyed to prevent rotation of the bolt 114 while the user is performing a variety of exercises and swinging the swinging arm 101 (and platform 102). In other words, the motion of the swinging arm 101 may have a tendency to cause the bolt 114 to rotate slightly and loosen itself from the tension control knob 116. To prevent this, the bolt 114 can be fixed from rotation using any mechanism, technique, or device. As a non-limiting example, the bolt 114 can be keyed (such as having a groove cut in a side of the bolt 114). A channel or protrusion can be formed in one of the pivot brackets 112 such that the channel passes through the groove on the bolt 114 when the bolt 112 is passed through the pivot brackets 112. Thus, in this aspect, the bolt 114 would be prevented for rotating because of the channel residing within the groove of the keyed bolt 114. As another non-limiting example, a pin or set screw can be positioned through the friction bushings 142 and into the keyed groove formed on the bolt 114.

The swinging platform 102 is any suitable platform that is operable for supporting a user's knees. For example, the swinging platform 102 can be a metal plate, plastic, plywood, or any other suitable component that can be connected (via welding, molded as a single component, screwed, etc.) with the swinging arm 101 and support a user's weight and knees. To provide additional comfort, a knee pad 118 (e.g., foam pad or fabric covered foam pad) can be affixed with and positioned upon the swinging platform 102.

When using the machine in various exercises, a user may opt to position their knees upon the swinging platform 102 to perform abdominal exercises. To assist in supporting the user's weight, adjustable forearm supports 122 are included that are connected with either the front 108 or rear 110 legs. In the example as depicted, the forearms supports 122 are adjustably connected with the front legs 108. The forearm supports 122 are desirably foam covered plates (e.g., metal, plastic, or wood plates) or other structurally stable members that are suitable for supporting the weight of the user when performing an exercise and placing forearms upon the forearms supports 122. Because the forearm supports 122 are angled downward away from a user, they provide for stabilization of the user and reduce user fatigue during use.

Additionally, handles 126 project upward and in front of the forearms supports 122 to further assist a user in stabilizing his/her body form while performing exercises with the swinging platform 102. The handles 126 are attached with the exercise machine 100 at any suitable location. For example, the handles 126 can project from the forearm supports 122, be attached (via welding, screws, etc.) directly to the front legs 108, or be attached (via welding, etc.) to a belly bar (described in further detail below) that is affixed with the front legs 108.

Figure 2:
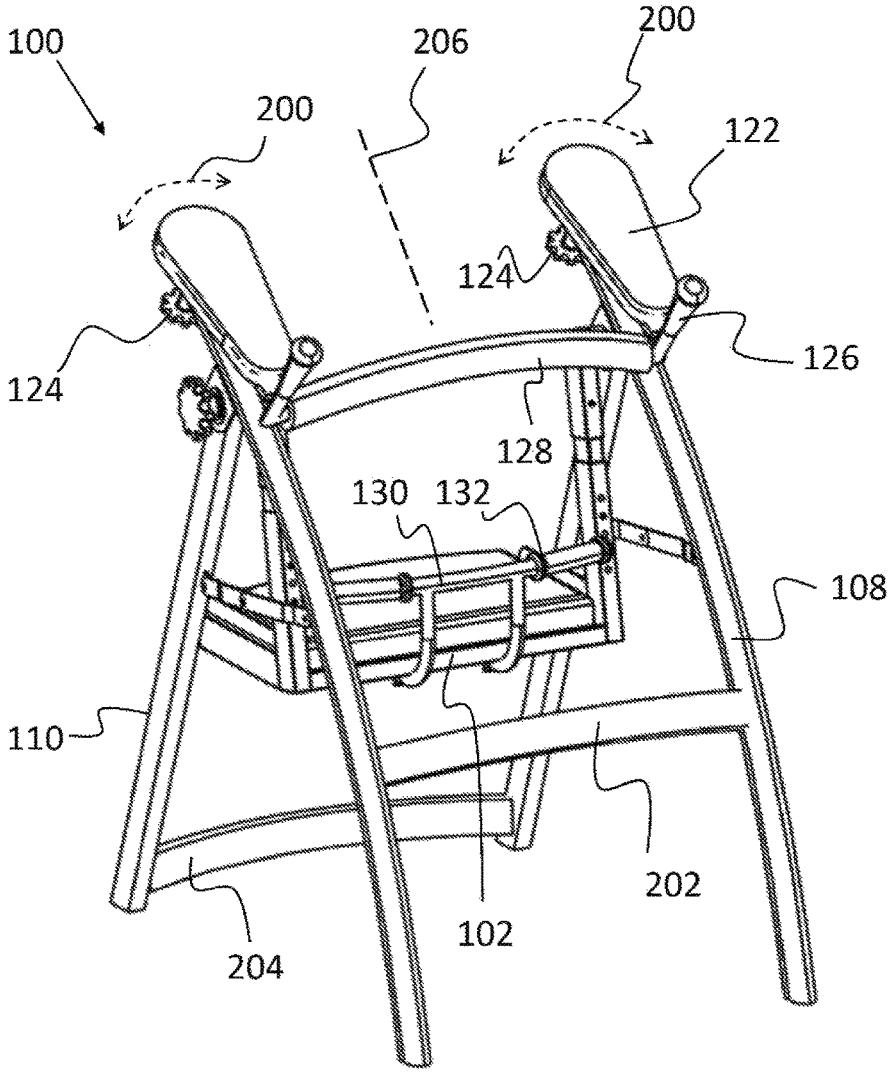
FIG. 2 is an elevated, front-view illustration of the exercise machine according to various embodiments of the present invention.

In various embodiments, the forearm supports 122 can be formed in any suitable manner for allow lateral adjustment. As a non-limiting example, the forearm supports 122 are pivotally connected with the handles 126 (via a tab, for example, that projects from the forearm supports 122 and rests within a hole in the handles 126). An adjustment knob 124 is attached with the forearm supports 122 for allowing a user to selectively laterally adjust the rear end of the forearm supports 122, thereby selectively altering the lateral angle of the forearm supports 122. As a non-limiting example and as shown in FIG. 2, the forearm supports 122 rest upon a forearm plate 210 that is welded to the front legs 108. The forearm supports 122 can be swung laterally 200 inwards (towards the center line 206 of the exercise machine 100) or laterally outward (away from the center line 206). This adjustment is made by loosening the adjustment knobs 124 underneath (which threads into a bottom side of the forearm support 122 (via a nut that slides within a groove 212) and pulls the forearm support 122 tight against the forearm plate 210) and then laterally 200 swinging the rear end of the support 122 inward or outward. This is important because larger individuals need the forearm supports 122 adjusted outward, while smaller individuals are more comfortable with the forearm supports 122 adjusted inward.

When performing a variety of exercises, a user may have a tendency to lean forward during the exercise. Referring again to FIG. 1A, to further support the user, a belly bar 128 (e.g., foam covered steel tubing) spans between the front legs 108 and is attached with the front legs 108 via welding, screws, or using any other suitable technique or device. The belly bar 128 can be formed in any suitable shape and at any suitable height. Desirably, the belly bar 128 is curved to accommodate the user's body form and is attached (via welding, bolts, etc.) at a height that is approximately aligned with the pivotal connection between the swinging platform 102 and the front 108 and rear 110 legs.

Figure 11:
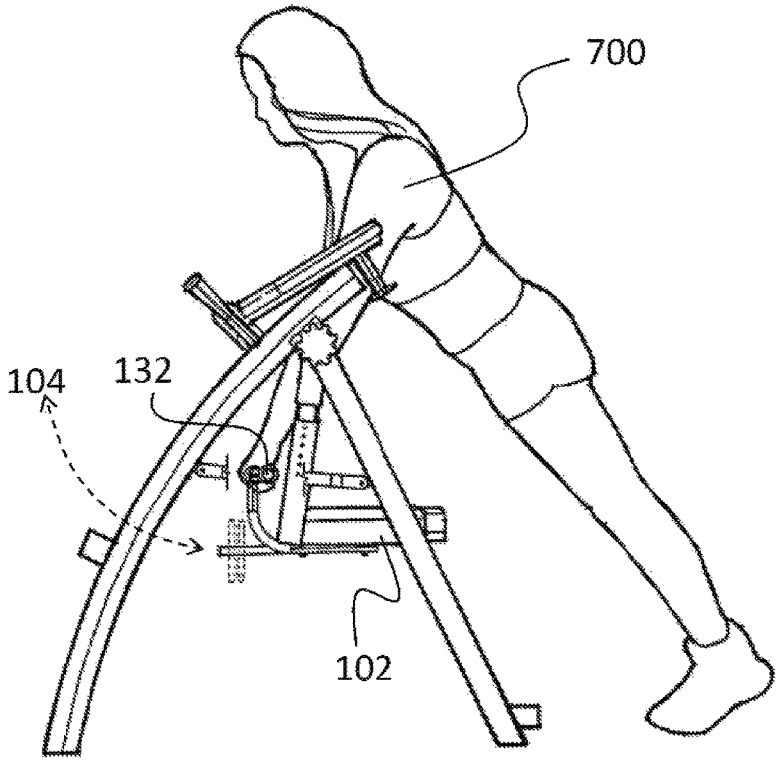
FIG. 11 is a side-view illustration of the exercise machine according to various embodiments of the present invention, depicting a user performing an exercise using the exercise machine.

A front knee support 130 (e.g., metal tubing, a plate, etc.) is also included that is connected (via welding, bolts, etc.) with and projects up from the swinging platform 102. The front knee support 130 provides a front brace or stop for the user's knees while performing abdominal exercises. Further, the front knee support 130 can also be formed to include a pair of handles 132 that can be grasped by a user while performing a variety of exercises (one example of which is depicted in FIG. 11).

It should be noted that the swinging platform 102 can also be formed to provide for selective adjustment of the platform 102 with respect to its elevation from a ground surface. Or stated in the alternative, the swinging platform 102 can be adjusted to raise and lower it with respect to the pivotal connection (i.e., at the threaded bolt 114). As a non-limiting example, each swinging arm 101 can be formed to include an upper arm part 134 and a lower arm part 136 that are telescoping with one another to allow for selective adjustment of the overall length of the swinging arm 101 (as formed collectively by the upper arm part 134 and lower arm part 136). As a non-limiting example and as understood by those skilled in the art, a portion of either the upper arm part 134 or the lower arm part 136 can be formed to slide within the other arm part and be selectively locked in place through inclusion of a locking system (e.g., a detent button, etc.).

The length of the swinging arm 101 can be altered to accommodate users of different body sizes. Further, altering the length of the swinging arm 101 provides for selective adjustment of the resistance while performing exercises. For example, increasing the length extends the user's body parts (e.g., knees, etc.) further from their core and, in doing so, decreases body leverage and effectively increases resistance. In other words, increasing the length of the swinging arm 101 increases resistance for a user (making the exercise harder), while decreasing the length of the swinging arm 101 effectively decreases resistance for the user (making the exercise easier). It should also be noted that friction resistance can be selectively altered using any suitable mechanism or device. As a non-limiting example, the tension control knob 116 can simply be tightened which pulls the swinging arm 101 tighter against the pivot bracket 112, thereby increasing friction resistance. Alternatively, such friction resistance can be decreased by simply loosening the tension control knob 116.

Figure 3:
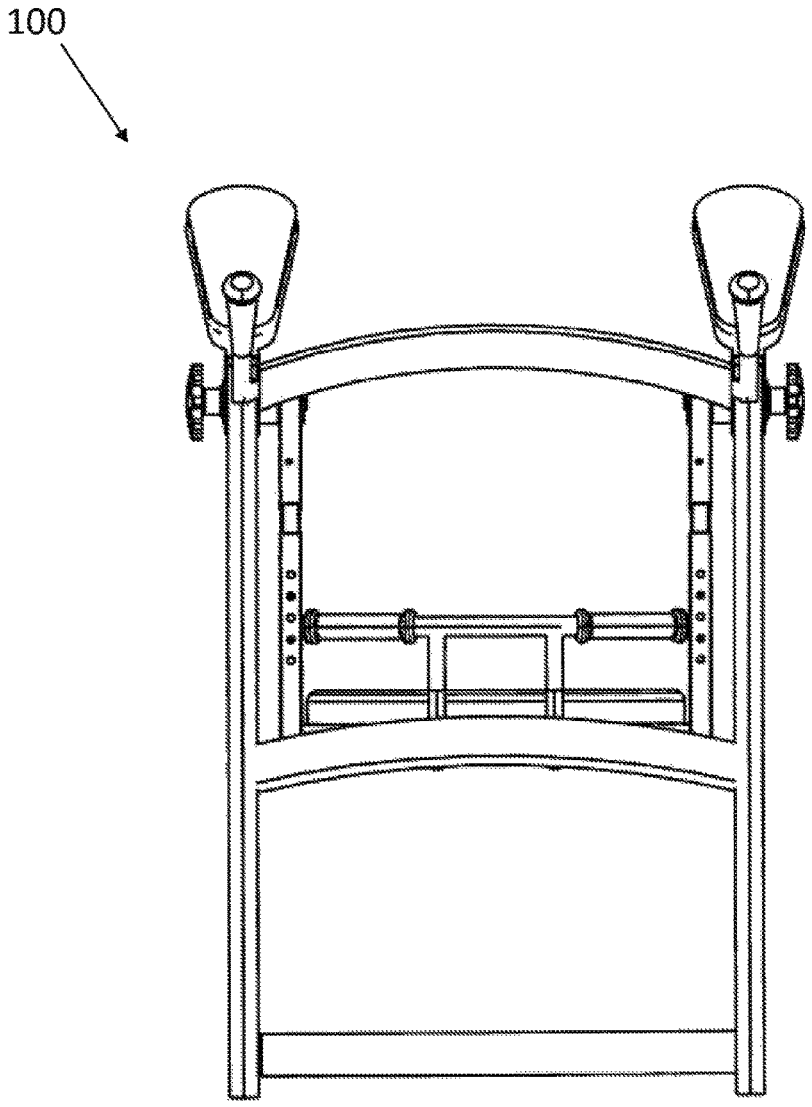
FIG. 3 is a front-view illustration of the exercise machine according to various embodiments of the present invention.
Figure 4:
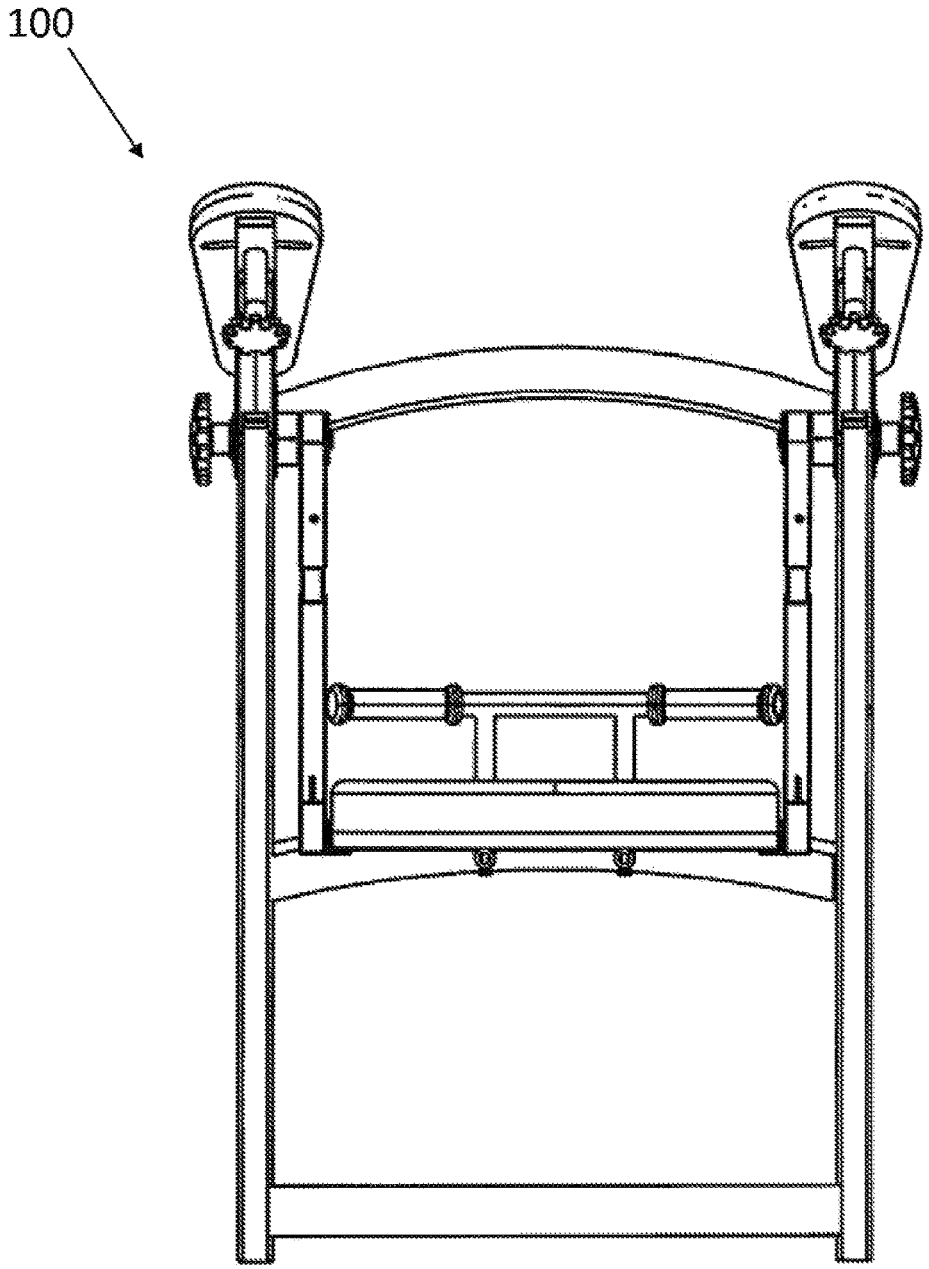
FIG. 4 is a rear-view illustration of the exercise machine according to various embodiments of the present invention.
Figure 5:
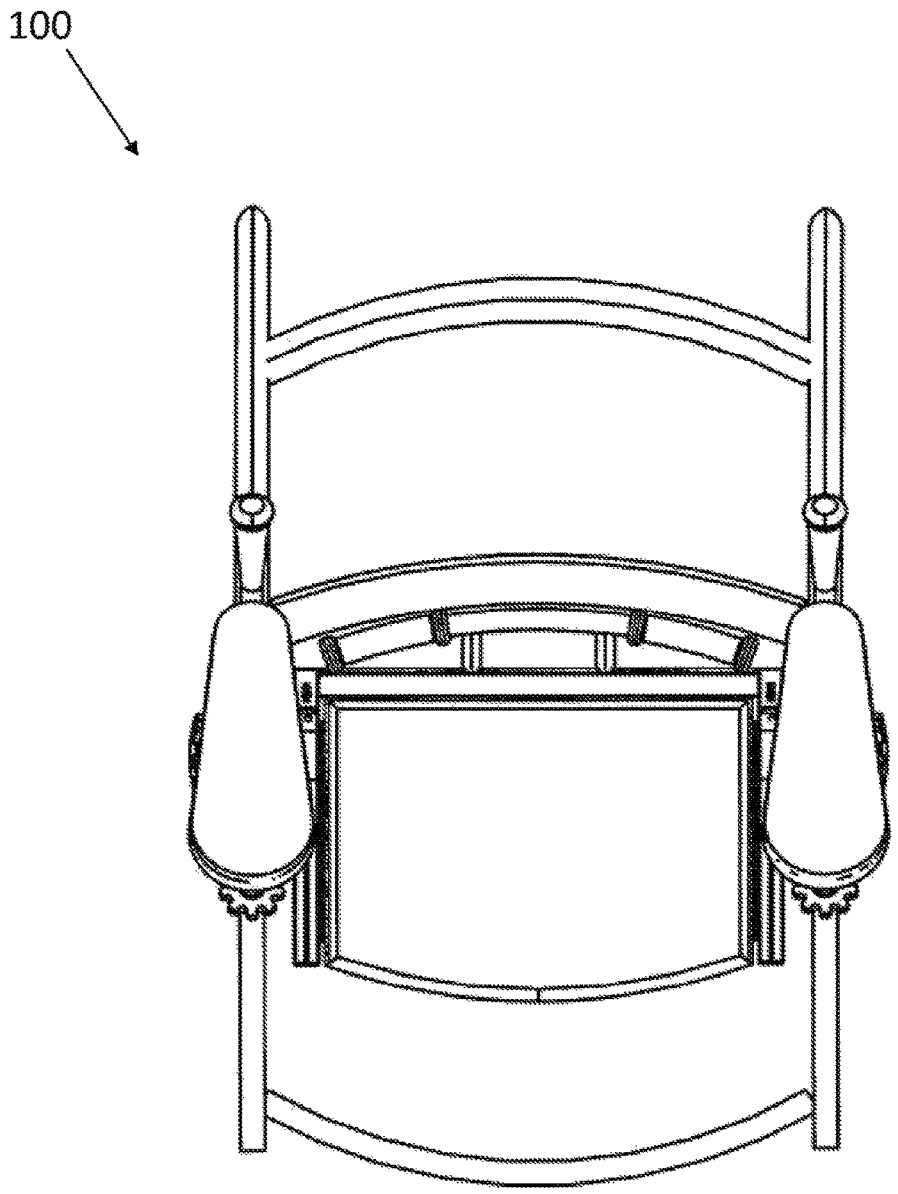
FIG. 5 is a top-view illustration of the exercise machine according to various embodiments of the present invention.

For further understanding, FIG. 2 provides an elevated, front-view illustration of the exercise machine 100. As shown, the foam covered belly bar 128 spans between the front legs 108 and includes handles 126 that project therefrom. The front knee support 130 with its handles 132 is also shown as projecting up from the swinging platform 102. For further illustration, FIGS. 3, 4, and 5 provide front, rear, and top-views, respectively of the exercise machine 100.

As noted above, the exercise machine 100 is optionally collapsible for ease of storage and portability. For example and as shown in FIG. 6A, the front legs 108 are pivotally connected 600 with the rear legs 110 to allow the legs to pivot away from one another into an expanded position that is ready for use. Folding brackets 120 or any other suitable locking mechanism can be connected between the front 108 and rear 110 legs to allow a user to selectively lock the legs 108 and 110 in the expanded position. As shown in FIG. 6B, the folding bracket 120 can then be folded or unlocked to allow the rear legs 120 to pivot toward the front legs 108 into a collapsed position for storage or transport.

Figure 7:
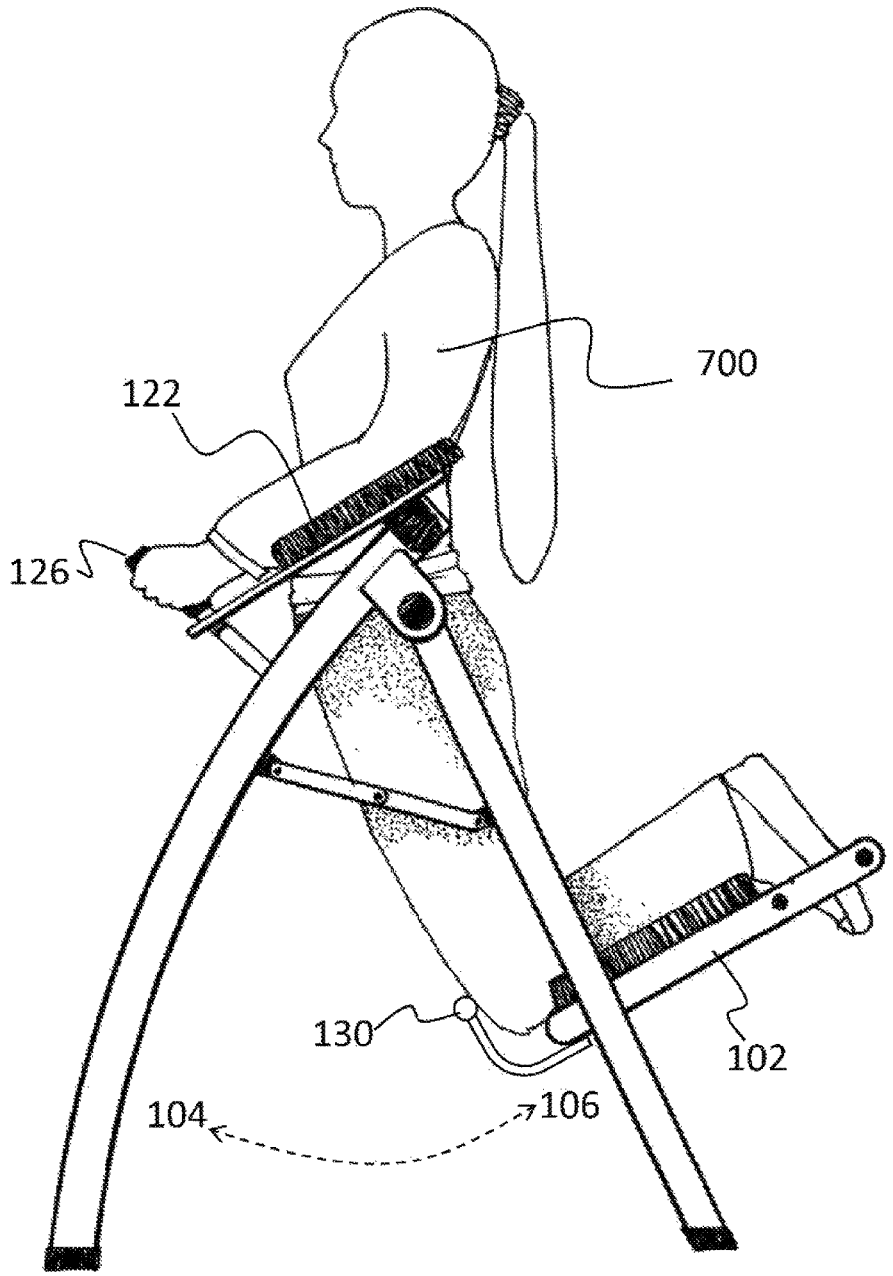
FIG. 7 is a side-view illustration of the exercise machine according to various embodiments of the present invention, depicting a user performing an exercise using the exercise machine.
Figure 8:
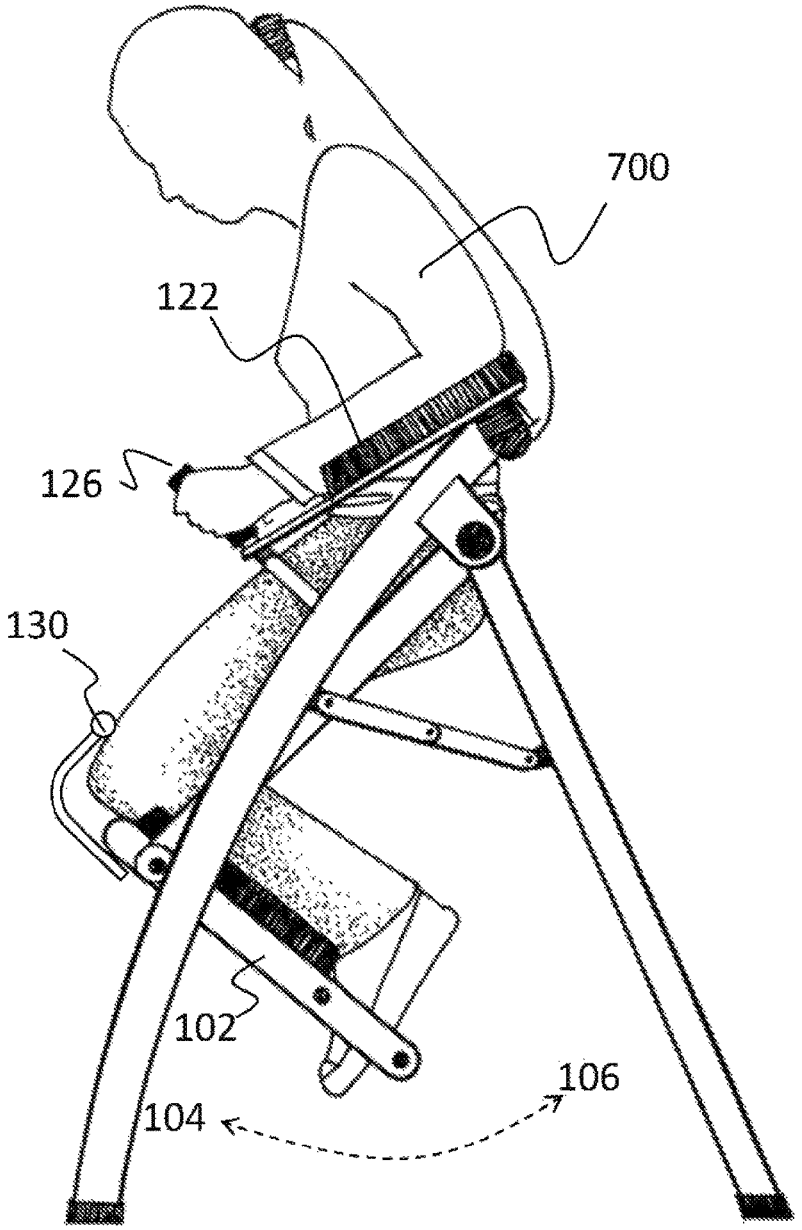
FIG. 8 is a side-view illustration of the exercise machine according to various embodiments of the present invention, depicting a user performing an exercise using the exercise machine.

When in the open and operating position and as shown in FIGS. 7 and 8, a user 700 can position her knees or shins on the swinging platform 102 while further supporting her weight using the forearm supports 122 and grasping the handles 126. As illustrated, the user's 700 weight is largely supported on her tibia and not the patella of the knee (reducing stress on the knees). Further, and during operation, because the swinging platform 102 allows for a forward 104 and rearward 106 swinging motion, the user 700 can swing her knees forward 104 to contract her abdominal muscles and perform an abdominal exercise. Also shown is an example of the front knee support 130 that provides the front brace or stop for the user's 700 knees.

Figure 9:
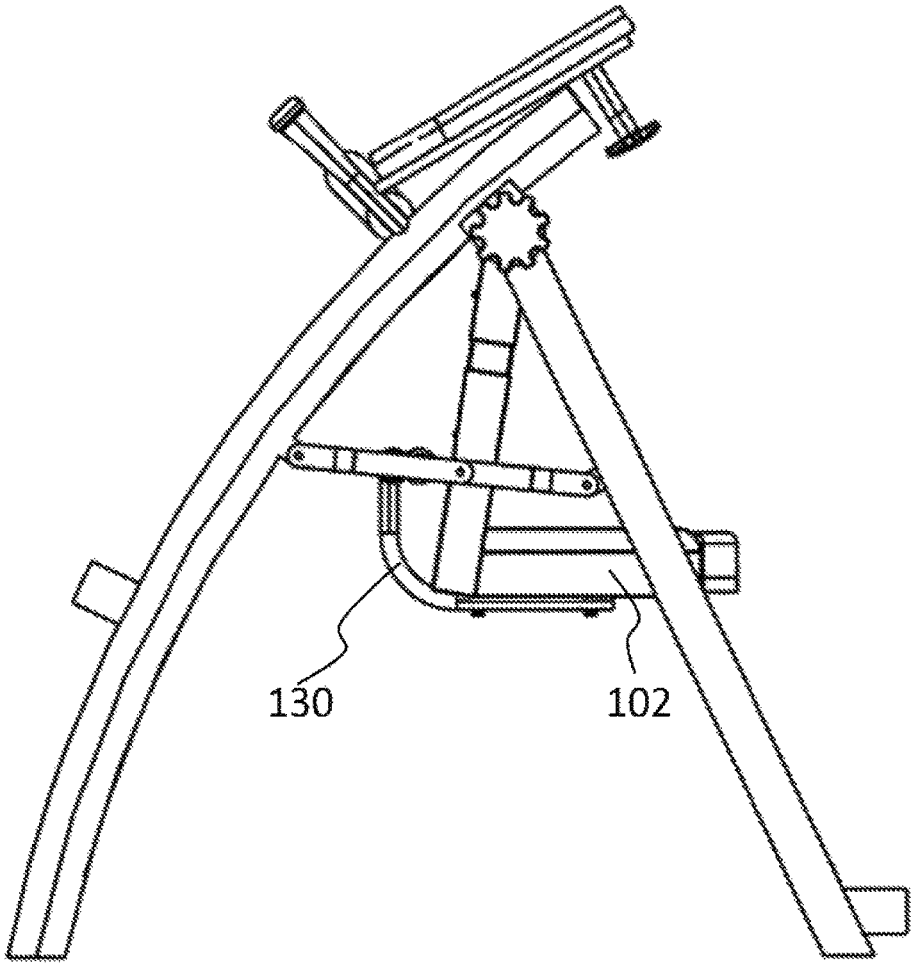
FIG. 9 is a side-view illustration of the exercise machine according to various embodiments of the present invention.

As noted above and as shown in the side-view illustration of FIG. 9, the swinging platform 102 optionally includes the front knee support 130. As depicted in this non-limiting example, the front knee support 130 is a tubular steel tube that is bolted onto the bottom of the swinging platform 102 and is bent to rise up and in front of the swinging platform 102.

Figure 10:
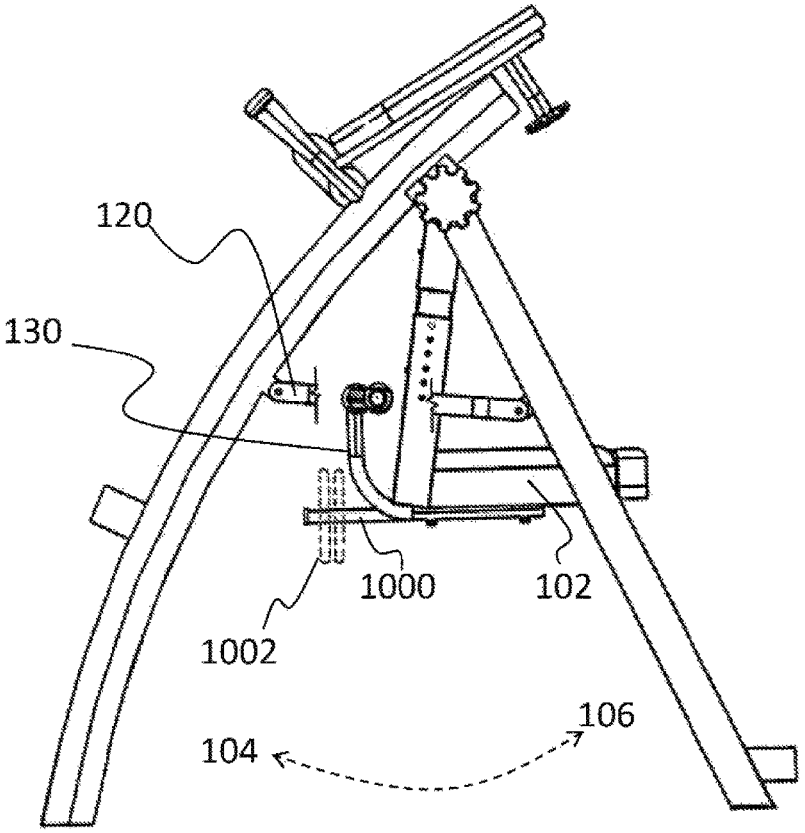
FIG. 10 is a side-view illustration of the exercise machine according to various embodiments of the present invention.

FIG. 10 further depicts this aspect with a portion of the folding bracket 120 removed for illustrative purposes. In the aspect as depicted in FIG. 10, a weight rod 1000 can also be affixed with the swinging platform 102. For example, the weight rod 1000 is steel piping that is welded to the front knee support 130 or directly bolted or otherwise affixed to the bottom of the swinging platform 102. The weight rod 1000 can be used to allow a user to selectively position weights 1002 around the weight rod 1000 to further increase resistance while performing a variety of exercises when swinging the swinging platform 102 forwards 104 and rearwards 106.

As noted above, the exercise machine can be used to perform a variety of exercises, including abdominal exercises (as illustrated in FIGS. 7 and 8) and a number of additional exercises. For example, lateral flexion with leg abduction (i.e., standing side crunch) can be performed by standing sideways within the exercise machine while resting a single knee upon the swinging platform. The user would then simply swing the resting knee outward and then contract the knee back inward to perform the exercise. Another example exercise is depicted in FIG. 11. In this example, the user 700 preforms a plank exercise by grasping the swinging platform 102 or handles 132 and swinging the swinging platform 102 forward 104 while maintaining a plank body form. Thus and as can be appreciated by those skilled in the art, there are a variety of exercises that can be performed by using the swinging platform 102 to support a portion of the user's body while swinging the platform 102.

Finally, while this invention has been described in terms of several embodiments, one of ordinary skill in the art will readily recognize that the invention may have other applications in other environments. It should be noted that many embodiments and implementations are possible. Further, the following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means". Further, while particular method steps may have been recited in a particular order, the method steps may occur in any desired order and fall within the scope of the present invention.

What is claimed is:

1. An exercise machine, comprising:

a frame, the frame having a front portion and a rear portion, with a vertical axis separating the front portion from the rear portion;

swinging arms hanging from and pivotally connected with the frame;

a swinging platform connected with the swinging arms;

a pair of forearm supports attached with the frame such that at least a portion of each of the forearm supports is angled downward and away from the vertical axis, such that when a user positions forearms within the pair of forearm supports, an axis passing through the user's forearms is directed downward and away from the user, whereby a user can position a body part upon the swinging platform and perform an exercise by swinging the swinging platform; and further comprising a knee pad connected with the swinging platform and a front knee support that is connected with the swinging platform, the front knee support projecting up from the swinging platform to a height exceeding a plane that lays upon the knee pad.

2. The exercise machine as set forth in claim 1, further comprising a pair of handles connected with the front knee support.

3. An exercise machine, comprising:

a frame;

swinging arms hanging from and pivotally connected with the frame with an adjustable friction mechanism, such that adjustment of the adjustable friction mechanism allows for selectively altering friction resistance of the swinging arms;

a swinging platform connected with the swinging arms;

a knee pad positioned upon the swinging platform; and a front knee support that is connected with the swinging platform, the front knee support projecting up from the swinging platform to a height exceeding a plane that lays upon the knee pad, whereby a user can position a body part upon the swinging platform and perform an exercise by swinging the swinging platform.

* * * * *